US006234853B1

(12) United States Patent
Lanyi et al.

(10) Patent No.: US 6,234,853 B1
(45) Date of Patent: May 22, 2001

(54) SIMPLIFIED DOCKING METHOD AND APPARATUS FOR A MULTIPLE ENGINE MARINE VESSEL

(75) Inventors: William D. Lanyi, Malone; Jeffery C. Ehlers; Blake R. Suhre, both of Neenah, all of WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/502,816

(22) Filed: Feb. 11, 2000

(51) Int. Cl.[7] ..... B63H 20/08
(52) U.S. Cl. ..... 440/53; 114/144 R
(58) Field of Search ..... 114/114 R, 144 E, 114/151, 55.5; 440/38, 40, 53, 84

(56) References Cited

U.S. PATENT DOCUMENTS 4,009,678 * 3/1977 North ..... 114/144 R
4,220,111 * 9/1980 Krautkremer ..... 114/144 R
4,691,659 * 9/1987 Ito et al. ..... 114/144 R
5,090,929 * 2/1992 Rieben ..... 440/40

* cited by examiner

*Primary Examiner*—Jesus D. Sotelo
(74) *Attorney, Agent, or Firm*—William D. Lanyi

(57) ABSTRACT

A docking system is provided which utilizes the marine propulsion unit of a marine vessel, under the control of an engine control unit that receives command signals from a joystick or push button device, to respond to a maneuver command from the marine operator. The docking system does not require additional propulsion devices other than those normally used to operate the marine vessel under normal conditions. The docking or maneuvering system of the present invention uses two marine propulsion units to respond to an operator's command signal and allows the operator to select forward or reverse commands in combination with clockwise or counterclockwise rotational commands either in combination with each other or alone.

20 Claims, 6 Drawing Sheets

SIMPLIFIED DOCKING METHOD AND APPARATUS FOR A MULTIPLE ENGINE MARINE VESSEL

BACKGROUND OF THE INVENTION

1. Field of the Invention

The present invention relates generally to docking systems for marine vessels and, more particularly, to a simplified docking system that uses two or more propulsion systems to maneuver a marine vessel for docking purposes.

2. Description of the Prior Art

Various types of docking systems are known to those skilled in the art. Also, many different types of push button controls and joystick controls are known to those skilled in the art.

U.S. Pat. No. 5,362,269, which issued to Leach on Nov. 8, 1994, describes a personal water vehicle. The jet motor powered water vehicle is intended for single person use. The jet powered boat includes a deck having a flat surface portion enabling a person to lie prone thereon while manually controlling the boat and steering the boat by utilizing a joystick mounted on the deck. The hull of the boat has a generally wide and shallow V-shaped configuration at a bore, lower portion thereof. The hull also has a flat bottom surface at mid and aft lower portions thereof which blend with the V-shape. The hull also includes a rear portion which is curved and upwardly slanted at a lower portion thereof.

U.S. Pat. No. 4,414,438, which issued to Maier et al on Nov. 8, 1983, describes a video game controller. The video game joystick controller includes a lower housing which defines a lower convex bearing surface, an upper housing which defines an upper concave bearing surface concentric with the lower bearing surface, and a handle which defines inner and outer bearing surfaces. The inner bearing surface of the handle is adapted to mate with the lower bearing surface of the lower housing and the outer bearing surface of the handle is adapted to mate with the upper bearing surface of the upper housing such that the handle is free to pivot with a smooth action.

U.S. Pat. No. 5,090,929, which issued to Rieben on Feb. 25, 1992, describes a paired motor system for small boat propulsion and steerage. Paired spaced electrically driven motors provide a steerable propelling system for small boats. Each motor drives a propeller carried in an elongate channel, communicating with each lateral side of a boat beneath the water line to one boat end, to move water through such channels for boat propulsion. The electrical motors are of variable speed, reversible, and separately controlled by a joystick type control device to provide differential control of motor speed to allow steerage. The propelling system provides a low speed, maneuverable propulsion system for fishing use, as an auxiliary power system for boats having a separate principal powering system, and to aid maneuverability alone or in conjunction with the principal powering system.

The patents described above are hereby expressly incorporated by reference in this description.

U.S. patent application Ser. No. 09/078,976, which was filed by Alexander et al on May 14, 1998 and assigned to the assignee of the present patent application, describes a water jet docking control system for a marine vessel.

Known docking systems require additional propulsion units to be employed solely for the purpose of maneuvering a marine vessel at low speeds for the purpose of docking the marine vessel. The requirement of maneuvering propulsion systems, in addition to the primary propulsion system, increases the cost of marine vessels. It would therefore be significantly beneficial if a means could be provided for allowing an operator to control the maneuvering of a marine vessel during docking procedures by utilizing the normal propulsion systems of the vessel. This would significantly simplify the maneuvering, or docking, process while minimizing the overall cost of the docking system.

SUMMARY OF THE INVENTION

A preferred embodiment of the present invention provides a method for maneuvering a marine vessel which comprises the steps of providing a first marine propulsion unit which is attachable to a transom of the marine vessel and also providing a second marine propulsion unit which is also attachable to the transom of the marine vessel. Although the present invention can also be utilized with a third marine propulsion unit, it is not necessary to provide additional marine propulsion units beyond a first pair. The present invention further comprises the steps of receiving a maneuver command signal from a manually controllable device. The manually controllably device can be a joystick or a plurality of push buttons which an operator can activate to convey a maneuver command to a controller of the present invention. The present invention further comprises the step of calculating a first magnitude of thrust for the first marine propulsion unit as a function of the maneuver command and calculating a second magnitude of thrust for the second marine propulsion unit as a function of the maneuver command. The first and second magnitudes of thrust are calculated to create a resultant force vector imposed on the marine vessel in combination with a resultant moment about an instantaneous center of turn of the marine vessel which will achieve the maneuver command received from the manually controllable device.

Certain embodiments of the present invention further comprise the steps of causing the first marine propulsion unit to provide the first magnitude of thrust and causing the second marine propulsion unit to provide the second magnitude of thrust. The causing steps of the present invention can comprise the steps of changing the operating speeds of engines which are associated with the first and second marine propulsion units. In other words, if the first and second marine propulsion units are outboard motors or stem drive systems with individual internal combustion engines, the operating speed of the two or more engines, measured in revolutions per minute, can be changed to appropriately affect the magnitudes of thrust produced by the first and second marine propulsion units. Alternatively, the causing steps of the present invention can comprise the steps of changing the pitch of each of two controllable pitch propellers associated with the first and second marine propulsion units.

Certain embodiments of the present invention can further comprise the steps of changing the relative position of the first marine propulsion unit relative to the transom in order to change the direction of the first magnitude of thrust relative to the marine vessel. Similarly, this embodiment of the present invention would also comprise changing the relative position of the second marine propulsion unit relative to the transom in order to change the direction of the second magnitude of thrust relative to the marine vessel. In other words, two outboard motors can be steered in a direction other than straight ahead in certain embodiments of the present invention while other embodiments can leave the two outboard motors positioned as they would be for straight ahead travel of the marine vessel. The first and second marine propulsion units can be stem drive systems, outboard motors, or inboard drives. The manually controllable device can be a joystick or a device which comprises a plurality of push buttons.

An apparatus made in accordance with the present invention comprises first and second marine propulsion units which are attachable to a transom of a marine vessel. It further comprises a manually controllable device which has an output that is representative of a maneuver command provided by a marine vessel operator. It also comprises first and second means for calculating a first magnitude of thrust and a second magnitude of thrust, respectively, for the first and second marine propulsion units, respectively, as a result of the maneuver command received from the manually controllably device. The first and second calculating means are typically incorporated as part of a micro-processor. The micro-processor can be included as a component within an engine control unit.

The present invention can further comprise means for causing the first and second marine propulsion units to actually provide the first and second magnitudes of thrust. This can be accomplished either by changing the operating speeds of the two engines associated with the two marine propulsion units or, alternatively, by changing the pitch of the blades of the controllable pitch propellers of the two marine propulsion units. The two marine propulsion units can be directed in a straight ahead configuration or, alternatively, can be positioned at directions other than perpendicular to the transom of the boat. These positions can provide parallel thrusts or, alternatively, thrust vectors which are not parallel to each other.

Throughout the description of the present invention, it should be clearly understood that the two or more marine propulsion devices are capable of providing thrust in either of two opposing directions, forward and reverse.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
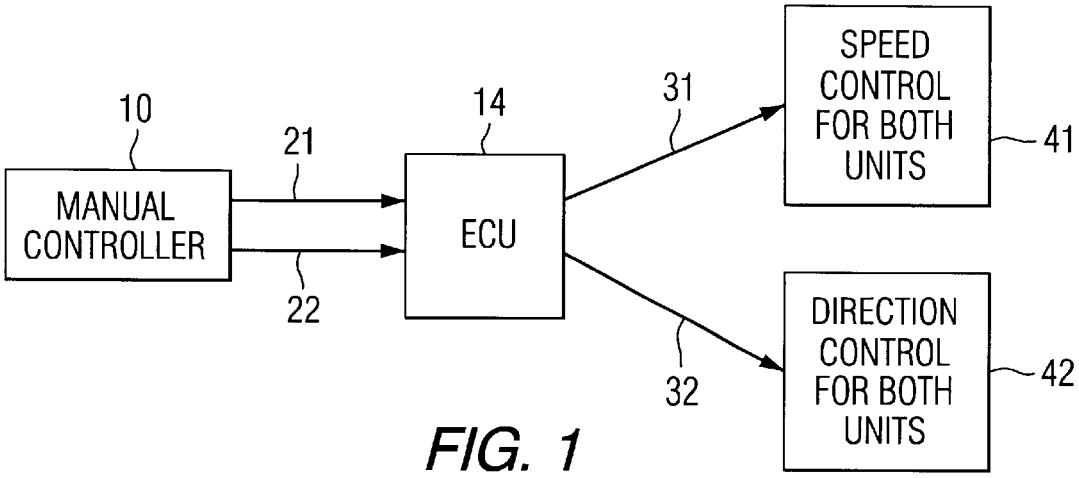
FIG. 1 is a simplified schematic representation of the present invention.

Throughout the description of the preferred embodiment of the present invention, like components will be identified by like reference numerals.

FIG. 1 shows the basic arrangement of the primary elements of the present invention. A manual controller 10 is provided to allow a marine vessel operator to provide an input representing a desired maneuvering activity. The manual controller 10 can be a joystick or a plurality of buttons by which the marine vessel operator is able to convey certain commands to an engine control unit 14 which represent maneuver commands. These commands can be relatively simple, such as straight ahead, reverse, rotate counterclockwise, and rotate clockwise. The engine control unit (ECU) 14 receives the commands from the manual controller 10, as represented by arrows 21 and 22. It a typical arrangement, the signals received on lines 21 and 22 would represent a choice between full speed ahead and full speed reverse on line 21 and between full speed counterclockwise and full speed clockwise on line 22. With these two inputs, the ECU 14 calculates the appropriate thrust values for the two marine propulsion units attached to the transom of the marine vessel and provides speed control commands for both units and direction control commands for both units. These are provided on lines 31 and 32, respectively. It should be understood that the present invention contemplates two distinctly different potential modes of operation. For example, the direction control for both units represented by box 42 in FIG. 1, in certain embodiments, can be a simple command to maintain both engines at perpendicular thrust vector positions relative to the transom of the marine vessel. In this mode of operation, with both marine propulsion units restricted to a straight ahead position relative to the transom, the speed commands for the two units, as represented by box 41 in FIG. 1 would vary in both magnitude and direction (i.e. forward or reverse) to achieve the maneuver command provided by the operator with the manual controller 10. Alternatively, the direction control for both marine propulsion units can provide commands which cause the two marine propulsion units to turn either to the left or right relative to the transom in a parallel maneuver or, alternatively, the two engines can be directed independently of each other.

It should be understood that the present invention anticipates the use of a "drive by wire" system in which physical connections are not provided between the operator's station and the marine propulsion units. Instead of using cables or mechanical linkages, as are common in many marine vessels, the marine vessel on which the present invention is used provides electronic signals which convey both steering and propulsion commands from the operator station to the marine propulsion units. In this type of system, no direct mechanical connection is provided between the operator's station and the marine propulsion units. As a result, the two marine propulsion units can be operated independently from each other, under the control of the ECU 14, in terms of both speed of operation and direction of the thrust vectors provided by the two marine propulsion units.

Figure 2:
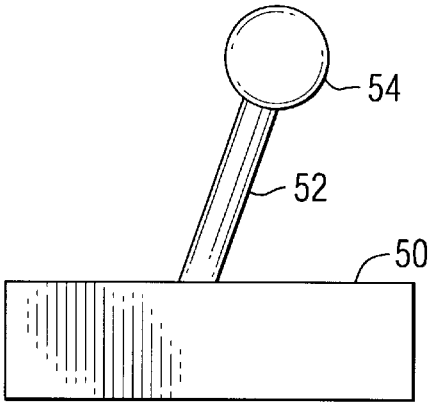
FIG. 2 shows a joystick that can be used with the present invention.
Figure 3:
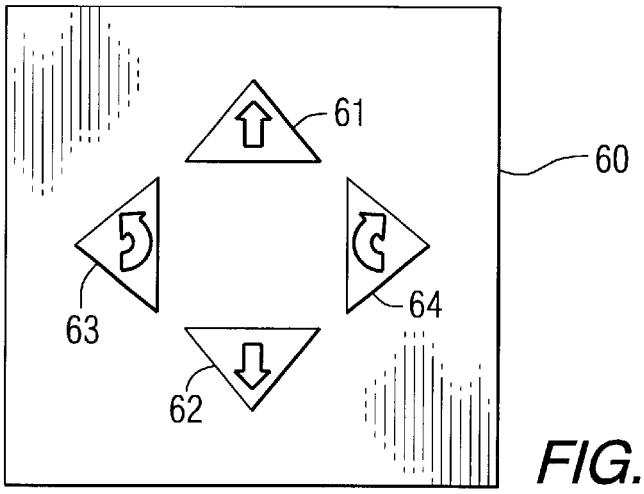
FIG. 3 shows a push button device that can be used in conjunction with the present invention.

FIGS. 2 and 3 show two possible types of manual controllers, such as that described above in FIG. 1 and identified by reference numeral 10. FIG. 2 shows a well known joystick device that comprises a base 50, a stick or lever 52, and an end configuration 54 that is suitable for movement by an operator's hand. Typically, the stick 52 can be moved left and right and forward and backward relative to the base 50. The operation of joysticks is very well known to those skilled in the art and will not be described in detail herein. FIG. 3 shows an alternative configuration that provides a base 60 which has four push buttons or pads 61–64. A forward pad 61 and a reverse pad 62 can be incorporated to provide the signal on line 21 of FIG. 1. Similarly, a counterclockwise rotation pad 63 and a clockwise rotation pad 64 can be combined to provide the signal on line 22 of FIG. 1. Regardless of whether a joystick is used or a plurality of push buttons is used, the basic signals received by the micro-processor of an engine control unit (ECU) 14 typically reflect a combined signal for the forward/rearward resultant command and another signal for the counterclockwise/clockwise resultant command. With the four buttons shown in FIG. 3, or the joystick shown in FIG. 2, an operator of a marine vessel can convey the desired maneuver command to the micro-processor of the present invention.

Throughout the description of the preferred embodiment, it should be understood that the force vectors, F1 and F2 can be positive or negative.

Figure 4:
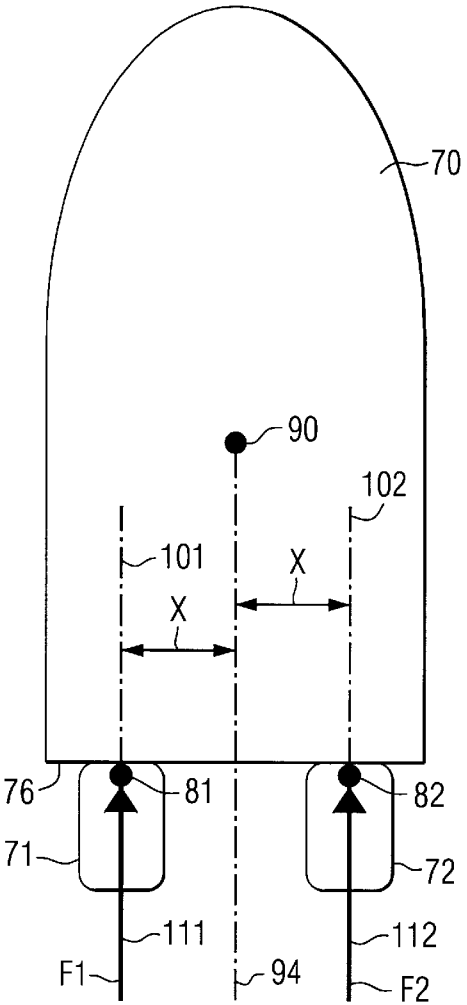

FIG. 4 is a highly simplified schematic representation of a marine vessel 70 with a first marine propulsion unit 71 and a second marine propulsion unit 72 attached for rotation to a transom 76 of the marine vessel 70. Points 81 and 82 represent the points about which the marine propulsion units can rotate while remaining attached to the transom 76. Point 90 represents the instantaneous center of turn of the marine vessel 70 in response to forces exerted on the marine vessel. In other words, the instantaneous center of turn 90 is a function of several factors which comprise the speed of the vessel as it moves through the water, the hydrodynamic forces on the hull of the marine vessel 70, the weight distribution of the load contained within the marine vessel 70, and the degree to which the boat is disposed below the waterline. The location of the instantaneous center of turn 90 can be empirically determined for various sets of conditions. For purposes of describing the operation of the present invention, it will be presumed that the location of the instantaneous center of turn 90 is known by the software operating within a micro-processor of the engine control unit 14. A centerline 94 of the marine vessel 70 is drawn through the instantaneous center of turn 90. Centerlines, 101 and 102, are shown extending through the first and second marine propulsion units, 71 and 72, co-linearly with the first and second thrust vectors, 111 and 112, produced by the first and second marine propulsion units, 71 and 72.

With continued reference to FIG. 4, it should be understood that a primary advantage of the present invention is that it uses the first and second marine propulsion units, 71 and 72, as the maneuvering or docking propulsion units by advantageously positioning the propulsion units relative to the transom 76 and selectively commanding each of the two engines associated with the propulsion units to produce a selected magnitude of thrust. By appropriately selecting the first and second magnitudes of thrust, 111 and 112, the marine vessel 70 can be maneuvered in response to a maneuver command received from the manually controllable device 10. In a normal situation, where the two marine propulsion units are spaced equally apart from the centerline 94, each of the two thrust vectors, 111 and 112, will produce a moment about the instantaneous center of turn 90 that is equivalent to the force of the vector multiplied by dimension X. The first magnitude of thrust 111 will produce a clockwise moment about the instantaneous center of turn 90 while the second magnitude of thrust 112 will produce a counterclockwise moment about the instantaneous center of turn 90. If the first and second magnitudes of thrust, 111 and 112 are equal to each other, a forward movement of the marine vessel 70 will result and there will be no rotational movement about the instantaneous center of turn 90. However, if the first and second magnitudes of thrust are unequal in either magnitude or direction, the marine vessel 70 will be caused to rotate about the instantaneous center of turn 90.

Figure 5:
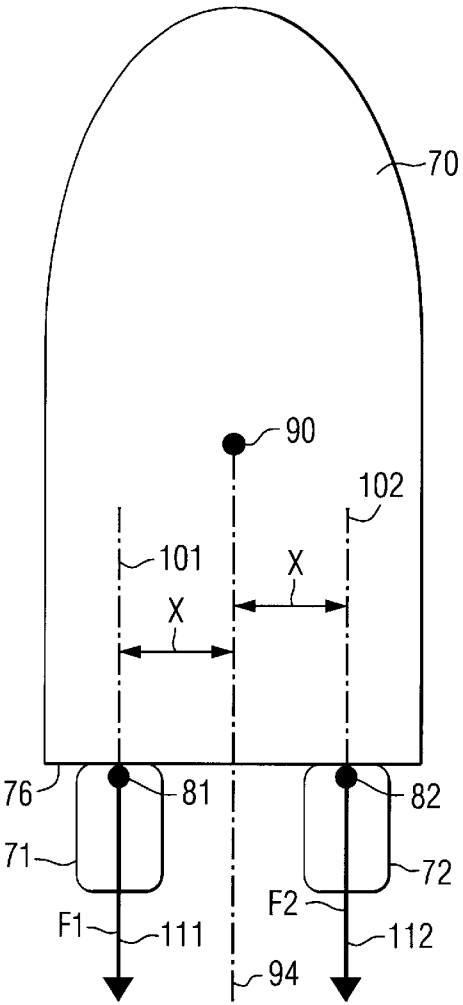
FIGS. 4–8 show various situations in which marine propulsion units are used to provide thrust vectors that are imposed on a marine vessel.

FIG. 5 is similar to FIG. 4, but the first and second magnitudes of thrust are reversed. This will result in a rearward movement of the marine vessel 70 if the two thrust vectors are equal in both direction and magnitude. If both marine propulsion units, 71 and 72, produce reverse thrust, but the two magnitudes of thrust are unequal, rotation of the marine vessel 70 about the instantaneous center of turn 90 will result.

With reference to FIGS. 4 and 5, the following equations describe the forces imposed on the marine vessel 70:

$$MCW=F1(X)-F2(X) \quad (1)$$

$$FR=F1+F2 \quad (2)$$

In the equations shown above, MCW is the moment in a clockwise direction about the instantaneous center of turn 90 and FR is the resultant force in a forward direction on the vessel 70 where vectors directed upwardly and toward the right are assumed to be positive and clockwise rotation is assumed to be positive. Naturally, if vector F2 is greater than vector F1 in magnitude, the moment in a clockwise direction MCW will be negative and will represent a moment in a counterclockwise direction.

It can be seen from equations 1 and 2, shown above, that the circumstance represented in FIG. 5 would result in a negative resultant force FR and the vessel 70 would move in a reverse direction. Depending on the magnitudes of the two vectors, F1 and F2, the marine vessel 70 could move directly in a reverse direction without any rotation about the instantaneous center of turn 90 or the marine vessel 70 can also rotate about the instantaneous center of turn.

Figure 6:
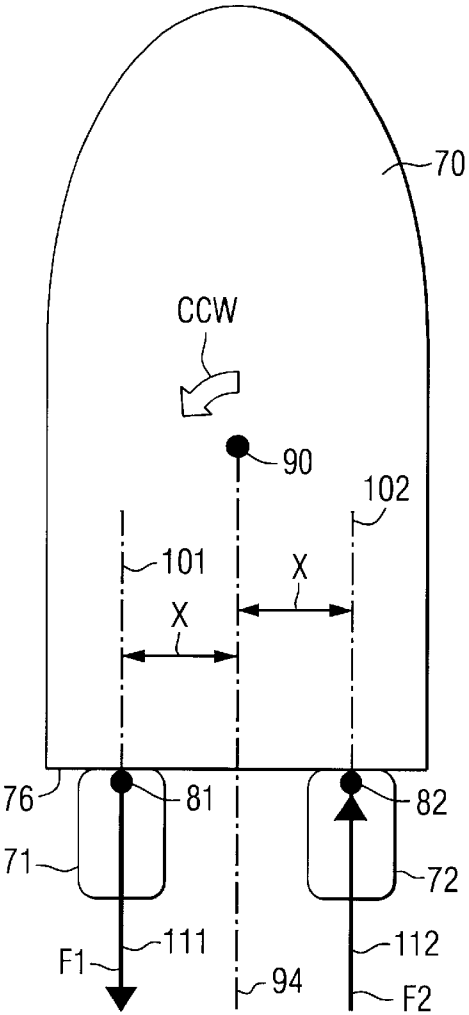

FIG. 6 shows a circumstance in which the two marine propulsion units produce force vectors in opposite directions. This will result in a counterclockwise rotation of the marine vessel 70 about the instantaneous center of turn 90 as represented by arrow CCW. Depending on the relative magnitudes of the first and second thrust vectors, F1 and F2, the marine vessel 70 may also move in a forward or reverse direction in combination with the counterclockwise rotation. The magnitudes of the force vectors are determined by the present invention based on the inputs received as the maneuver command from the manual controller 10. If no port or starboard commands, as represented by buttons 63 and 64 in FIG. 3, are received from the manual controller 10, the micro-processor of the engine control unit 14 would calculate equal thrust vectors, F1 and F2, to respond to a counterclockwise command on push button 63.

Figure 7:
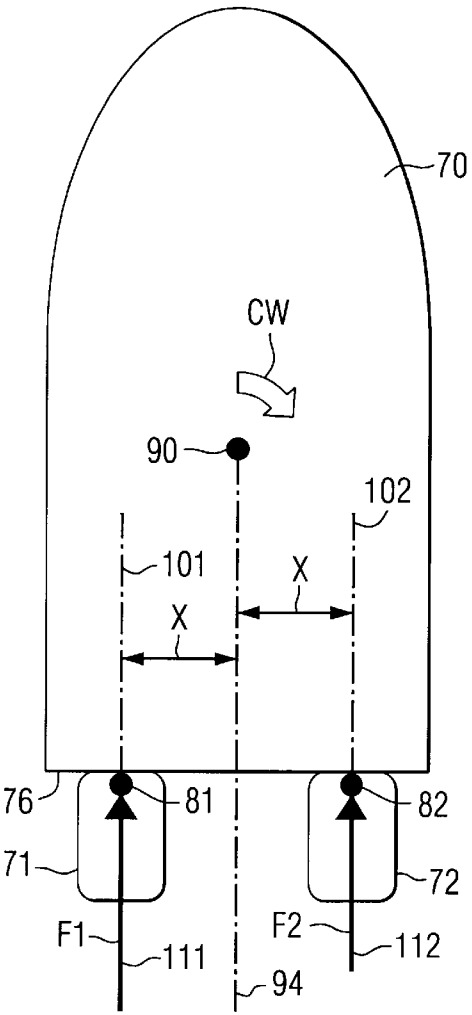

FIG. 7 shows a situation in which the first and second thrust vectors, F1 and F2, are in the same direction, but are clearly of different values. This would produce a clockwise rotation of the marine vessel 70 about the instantaneous center of turn 90, as represented by arrow CCW and would simultaneously result in a forward motion of the marine vessel 70.

With reference to both FIGS. 6 and 7, it should be understood that each of the two force vectors in both drawings can be reversed to result in the opposite effect. With reference to FIGS. 4, 5, 6, and 7, it can be seen that the stationary positions of the first and second marine propulsion units, 71 and 72, relative to the transom 76, can be advantageously used to move the marine vessel 70 straight ahead as shown in FIG. 4 or directly in reverse as shown in FIG. 5 by maintaining equal thrust vectors from both marine propulsion units. It can also be seen that a counterclockwise or clockwise rotation of the marine vessel 70 can be achieved by providing equal force vectors, F1 and F2, in opposite directions as shown in FIG. 6. FIG. 7 illustrates that force vectors of unequal magnitudes can be used to combine clockwise or counterclockwise rotation of the marine vessel 70 about its instantaneous center of turn 90 in combination with a net forward or reverse movement. None of the maneuvers described above in conjunction with FIGS. 4, 5, 6, and 7 require that the first or second marine propulsion systems, 71 or 72, be moved away from a straight ahead position in which their respective thrust vectors, F1 and F2 are generally perpendicular to the transom 76 of the marine vessel 70.

Figure 9:
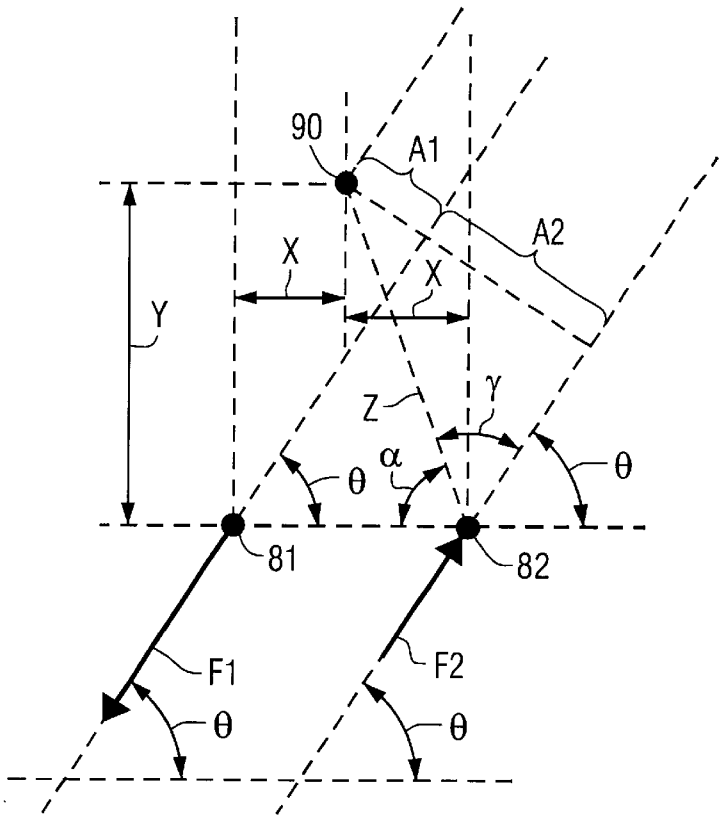
FIG. 9 is a thrust vector diagram representing one possible combination of thrust vectors on a marine vessel.
Figure 8:
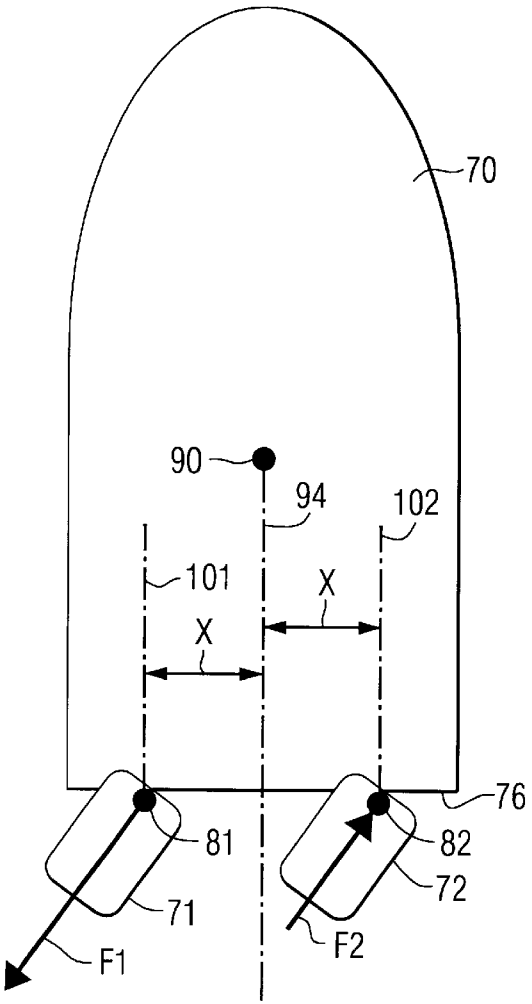

FIGS. 8 and 9 represent a situation in which the two marine propulsion units, 71 and 72, are positioned in a non-perpendicular association with the transom 76. The two marine propulsion units are both moved to a position in which their respective thrust vectors, F1 and F2, remain parallel to each other. The diagram in FIG. 9 represents the geometric relationships resulting from the movement of the marine propulsion units to a position shown in FIG. 8. The following equations describe the relationships in FIG. 9:

$$MCW=F1(A1) \tag{3}$$

$$MCCW=F2(A1+A2) \tag{4}$$

$$FX=-F1\cos\theta+F2\cos\theta \tag{5}$$

$$FY=-F1\sin\theta+F2\sin\theta \tag{6}$$

$$MCCW=F2(A1+A2)-F1(A1) \tag{7}$$

Equations 3–6 describe the resultant moments and forces acting on the marine vessel 70 in response to the first and second thrust vectors, F1 and F2. These include the clockwise moment MCW, the counterclockwise moment MCCW, the resultant force FX in the X direction, which is the left and right direction in FIGS. 8 and 9, and the resultant force FY in the Y direction, which is the upward and downward force in FIGS. 8 and 9. Through the use of equations 3–6, the micro-processor of the engine control unit 14 can determine the required force vectors, F1 and F2, and the required angle θ to achieve the maneuver command received from the manual controller 10 which is controlled by the operator of the marine vessel. Equation 7, shown above, is a combination of equations 3 and 4 and defines the moment in the counterclockwise direction about the instantaneous center of turn 90 in terms of both force vectors, F1 and F2. With respect to FIGS. 8 and 9, it can be seen that force vector F1 is negative and force vector F2 is positive according to the normal convention adopted above.

With respect to FIG. 9, all of the angles and dimensions can be determined easily through normal geometric procedures. For example, the magnitude of dimension Z between the instantaneous center of turn 90 and either of the two points of rotation, 81 and 82, can be determined through the Pythagorean Theorem because dimension X and dimension Y are both known since they are empirically determinable for any particular marine vessel 70 and operating condition. Dimension A1, which is the moment arm for the first thrust vector F1 about the instantaneous center of turn 90, is equal to the magnitude of dimension Z multiplied by the sine of angle θ. The other angles can be determined through the arc sine calculation of sides Y and Z and the fact that the three angles shown in FIG. 9, added together, are equal to 180 degrees. The sum of dimensions A1 and A2 can be determined because the magnitude of dimension Z is known and the magnitude of the angle encompassed between line Z and the line that is co-linear with the thrust vector F2 is known. As a result, the clockwise and counterclockwise moments about the instantaneous center of turn 90 can be determined and the net thrust in both the X and Y directions in FIG. 9 can be determined based on the equations 3–6 shown above.

Figure 10:
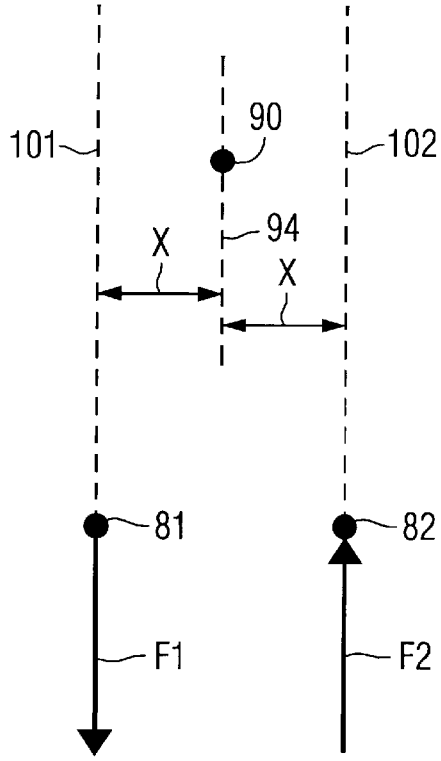
FIG. 10 shows a simplified vector diagram showing a possible combination of thrust vectors on a marine vessel.

FIG. 10 is a simplified diagram of the forces described above in conjunction with FIG. 6. Equations 3–6 can be used to determine the moments and net thrust vectors, as described above in conjunction with FIG. 9, with a value of θ that is 90 degrees. If a forward direction of the vessel 70 is preselected as being positive, the first thrust vector F1 would be negative and the second thrust vector F2 would be positive. Dimensions A1 and A2 described above in conjunction with equations 3–6, would be equal to dimension X shown in FIGS. 6 and 10. In other words, the same equations are applicable in the condition represented in FIGS. 8 and 9 and also in the condition represented in the earlier figures in which the thrust vectors, F1 and F2, from the first and second marine propulsion units, 71 and 72, are perpendicular to the transom 76.

Figure 11:
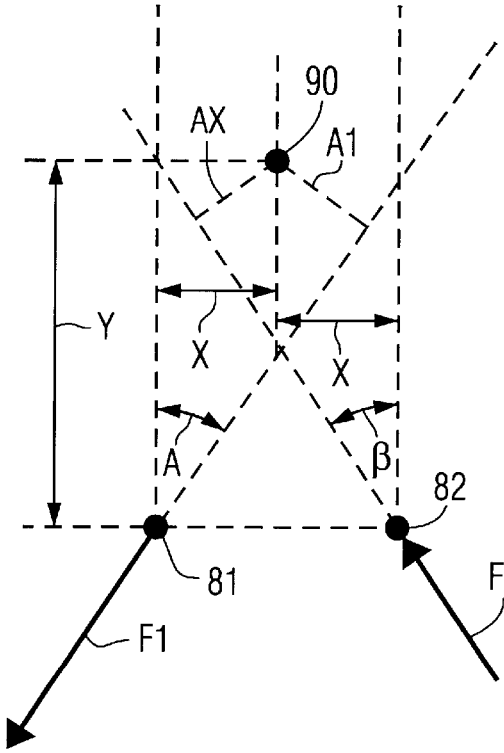
FIG. 11 shows a thrust diagram for a circumstance in which the thrust vectors provided by first and second marine propulsion units are not parallel to each other.

FIG. 11 represents a situation in which the two thrust vectors, F1 and F2 are not parallel to each other. Furthermore, the two thrust vectors can be of different magnitudes and directions. It can be seen that the clockwise and counterclockwise moments about the instantaneous center of turn 90 and the net resultant thrust vectors in the forward and sideways directions can be geometrically determined since dimensions X and Y are known for any particular marine vessel 70, angles A and B are known because they are under direct control of the engine control unit 14, dimensions A1 and AX can be geometrically determined from the known dimensions. Therefore, although the equations used to select the appropriate first and second thrust magnitudes, F1 and F2, may be different than equations 3–6 described above, they are easily determinable by one skilled in the art based on the known dimensions shown in FIG. 11.

Figure 12:
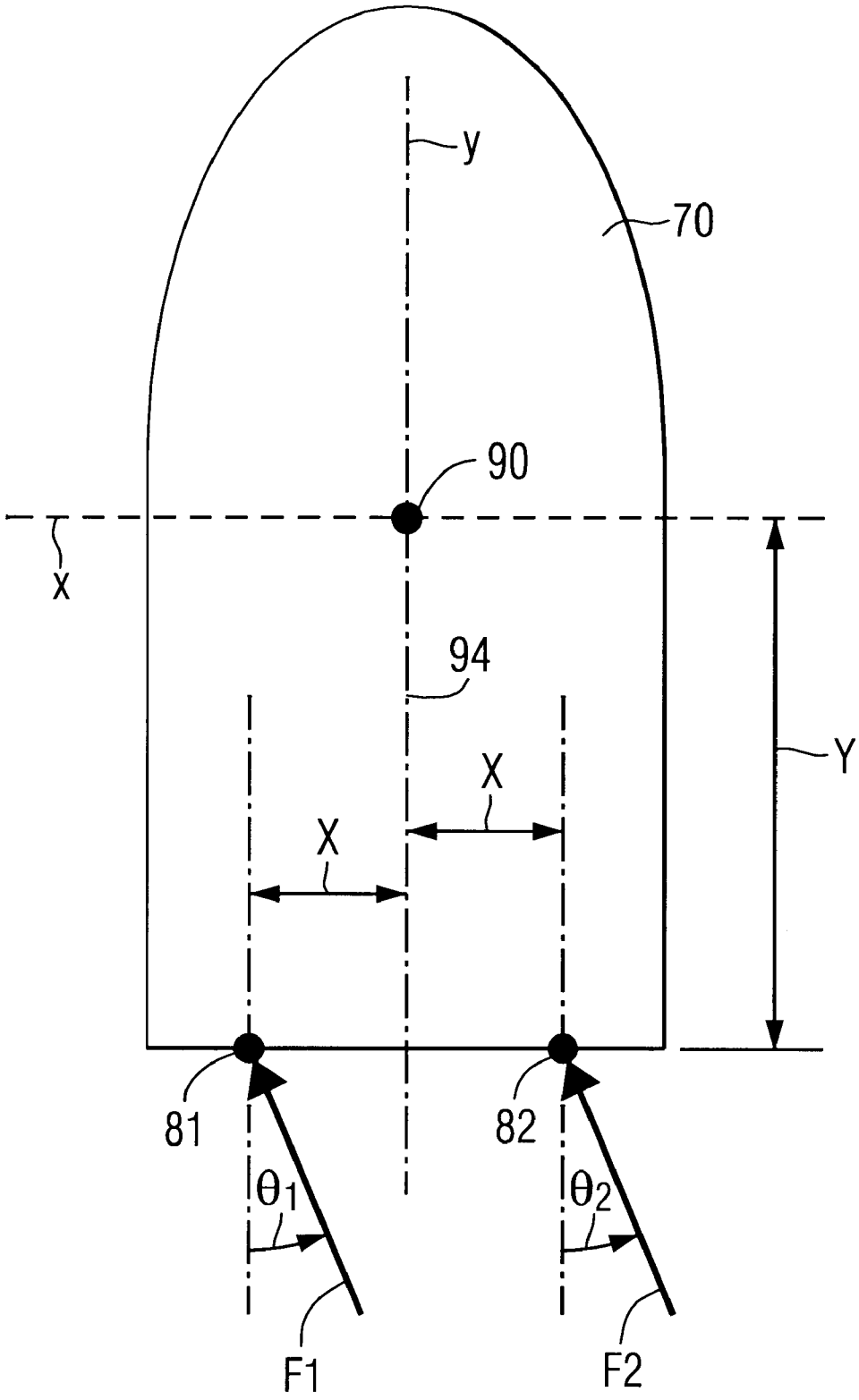
FIG. 12 shows a variation of the present invention for independently movable outboard motors.

FIG. 12 is provided in order to illustrate, with specificity, how two marine propulsion devices can be used to provide a wide range of possible movements of the marine vessel 70 if the two marine propulsions devices are independently steerable. Following the conventions adopted above, the two marine propulsion devices can each provide force vectors, F1 and F2, in either a positive or negative direction. As can be seen in FIG. 12, the angle between these two force vectors parallel to the centerline 94 are defined as $\Theta_1$ and $\Theta_2$. The resulting forces, in the directions parallel to the X axis and Y axis in FIG. 12, referred to as FX and FY, respectively, can be determined by the following equations.

$$FX=-F1(\sin(\Theta_1))-F2(\sin(\Theta_2)) \tag{8}$$

$$FY=F1(\cos(\Theta_1))+F1(\cos(\Theta_2)) \tag{9}$$

$$MCT=-Y(F1(\sin(\Theta_1)))-X(F1(\cos(\Theta_1)))-Y(F2(\sin(\Theta_2)))+X(F2(\cos(\Theta_2))) \tag{10}$$

In equations 8–10, shown above, FX and FY represent the resulting forces on the marine vessel 70 in the directions parallel to the X axis and the Y axis 94. The moment about the center of instantaneous turn 90, which is identified above as MCT, represents the net effect of both thrust vectors, F1 and F2, on the marine vessel 70 which will induce the vessel to rotate about the instantaneous center of turn 90. By using the equations shown above, the desired movement of the marine vessel 70 can be selected in terms of FX and FY and the rotation about the instataneous center of turn 90.

It should be understood that either of the two marine propulsion devices can be fixed at a preselected angle while the other marine propulsion device is rotated about its respective points, 81 or 82, to obtain a desired result. Table I represents 12 examples of how these results can be obtained.

TABLE I

| EXAMPLE | FX | FY | MCT | $\Theta_2$ | F1 | F2 |
|---|---|---|---|---|---|---|
| 1 | 0 | 10 | 0 | 0 | 5 | 5 |
| 2 | 10 | 10 | 0 | 12.53 | 55 | −46.1 |
| 3 | 10 | 0 | 0 | 11.31 | 50 | −50.99 |
| 4 | 10 | −10 | 0 | 10.3 | 45 | −55.9 |
| 5 | 0 | −10 | 0 | 0 | −5 | −5 |
| 6 | −10 | −10 | 0 | 12.53 | −55 | 46.1 |
| 7 | −10 | 0 | 0 | 11.31 | −50 | 50.99 |
| 8 | −10 | 10 | 0 | 10.3 | −45 | 55.9 |
| 9 | 0 | 0 | 10 | 0 | −10 | 10 |
| 10 | 0 | 0 | −10 | 0 | 10 | −10 |
| 11 | 10 | 10 | 10 | 15.95 | 45 | −36.4 |
| 12 | 10 | 10 | −10 | 10.3 | 65 | −55.9 |

With respect to example 1 in Table I, it can be seen that no starboard or port movement is desired while a forward movement of 10 units is desired with no rotation about the instantaneous center of turn 90. It should be understood that in all of the examples shown in Table I, the port marine propulsion device is fixed with angle $\Theta_1$ equal to zero. In example 1 shown above, the starboard marine propulsion device is positioned with angle $\Theta_2$ equal to zero and both propulsion devices are controlled to provide a force of five units each.

With continued reference to FIG. 12 and Table I, example 2 shows a desired combination of thrusts on the marine vessel 70 of 10 units in the starboard direction and 10 units in the forward direction. In order to obtain this result with the port marine propulsion device set at 0 degrees, as described above, the starboard marine propulsion device would be set at an angle $\Theta_2$ equal to 12.52 degrees and with F1 equal to 55 units and F2 equal to −46.1 units.

It can be seen that examples 1 through 8 in Table I all result in no rotation about the instantaneous center of turn 90. Examples 9 and 10 result in no starboard or forward forces, but with a rotation of the marine vessel 70 about the instantaneous center of turn 90. Examples 11 and 12 in Table I result in starboard and forward forces in combination with rotations of the marine vessel 70 about the instantaneous center of turn 90.

As described above, the examples illustrated in Table I and shown in FIG. 12 all assume that the port marine propulsion device is set at an angle $\Theta_1$ equal to zero and all of the maneuvering is performed with movements of the starboard marine propulsion device in combination with changes in the thrust vectors provided by the two marine propulsion devices. It should be understood that this is a highly simplified example and, furthermore, that a full range of movements of the marine vessel 70 can be accomplished by steering both marine propulsion devices independently from each other while not requiring that one of the marine propulsion devices be fixed relative to the transom of the marine vessels 70. However, the examples described above in conjunction with FIG. 12 clearly show the wide range of movements that are possible when the two marine propulsion devices are independently steerable and independently controllable in terms of the magnitude and direction of the thrust provided by the two devices.

As described above, the present invention provides a method and apparatus for selectively determining the required thrust vectors produced by first and second marine propulsion units to achieve a maneuver command provided by a marine vessel operator through the use of a joystick or a series of push buttons. The method and apparatus of the present invention do not require additional marine propulsion units beyond those needed to propel the marine vessel under normal conditions. The joystick or push button commands received from the manual controller are used to calculate the required thrust vectors for the two propulsion units and the thrusts are then controlled to achieve the commanded maneuver.

Although the present invention has been described with particular detail and illustrated specifically to show one or more preferred embodiments of the present invention, it should be understood that alternative embodiments are also within its scope.

What is claimed is:

1. A method for maneuvering a marine vessel, comprising the steps of:

providing a first marine propulsion unit which is attachable to a transom of said marine vessel;

providing a second marine propulsion unit which is attachable to said transom of said marine vessel;

receiving a maneuver command from a manually controllable device;

calculating a first magnitude of thrust for said first marine propulsion unit as a function of said maneuver command; and calculating a second magnitude of thrust for said second marine propulsion unit as a function of said maneuver command, said first and second magnitudes of thrust being calculated to create a resultant force vector imposed on said marine vessel and a resultant moment about an instantaneous center of turn of said marine vessel which will achieve said maneuver command, said first and second magnitudes of thrust being unequal to each other in order to create a magnitude of said resultant moment about said instantaneous center of turn which is unequal to zero.

2. The method of claim 1, further comprising:

causing said first marine propulsion unit to provide said first magnitude of thrust; and causing said second marine propulsion unit to provide said second magnitude of thrust.

3. The method of claim 2, wherein:

said causing steps comprise the steps of changing the operating speeds of engines which are associated with said first and second marine propulsion units.

4. The method of claim 2, wherein:

said causing steps comprise the steps of changing the pitch of controllable pitch propellers associated with said first and second marine propulsion units.

5. The method of claim 1, further comprising:

changing the relative position of said first marine propulsion unit relative to said transom to change the direction of said first magnitude of thrust relative to said marine vessel; and changing the relative position of said second marine propulsion unit relative to said transom to change the direction of said second magnitude of thrust relative to said marine vessel.

6. The method of claim 1, wherein:

said first marine propulsion unit is a first outboard motor; and said second marine propulsion unit is a second outboard motor.

7. The method of claim 1, wherein:

said first marine propulsion unit is a first sterndrive system; and said second marine propulsion unit is a second sterndrive system.

8. The method of claim 1, wherein:

said manually controllable device is a joystick.

9. The method of claim 1, wherein:

said manually controllable device comprises a plurality of push buttons.

10. The method of claim 1, further comprising:

causing said first and second marine propulsion units to be positioned to direct the first and second magnitudes of thrust in a direction perpendicular to said transom.

11. An apparatus for maneuvering a marine vessel, comprising:

means for providing a first marine propulsion unit which is attachable to a transom of said marine vessel;

means for providing a second marine propulsion unit which is attachable to said transom of said marine vessel;

means for receiving a maneuver command from a manually controllable device;

first means for calculating a first magnitude of thrust for said first marine propulsion unit as a function of said maneuver command; and second means for calculating a second magnitude of thrust for said second marine propulsion unit as a function of said maneuver command, said first and second magnitudes of thrust being calculated to create a resultant force vector imposed on said marine vessel and a resultant moment about an instantaneous center of turn of said marine vessel which will achieve said maneuver command, said first and second magnitudes of thrust being unequal to each other in order to create a magnitude of said resultant moment about said instantaneous center of turn which is unequal to zero.

12. The apparatus of claim 11, further comprising:

means for causing said first marine propulsion unit to provide said first magnitude of thrust; and means for causing said second marine propulsion unit to provide said second magnitude of thrust.

13. The apparatus of claim 11, further comprising:

means for changing the relative position of said first marine propulsion unit relative to said transom to change the direction of said first magnitude of thrust relative to said marine vessel; and means for changing the relative position of said second marine propulsion unit relative to said transom to change the direction of said second magnitude of thrust relative to said marine vessel.

14. The apparatus of claim 11, wherein:

said manually controllable device is a joystick.

15. The apparatus of claim 11, wherein:

said manually controllable device comprises a plurality of push buttons.

16. The apparatus of claim 11, further comprising:

means for causing said first and second marine propulsion units to be positioned to direct said first and second magnitudes of thrust in a direction perpendicular to said transom.

17. The apparatus of claim 11, wherein:

an engine control unit comprises a microprocessor which comprises said first and second calculating means, said receiving means being connected in signal communication with said microprocessor.

18. An apparatus for maneuvering a marine vessel, comprising:

a first marine propulsion unit which is attachable to a transom of said marine vessel;

a second marine propulsion unit which is attachable to said transom of said marine vessel;

a manually controllable device which has an output that is representative of a maneuver command;

first means for calculating a first magnitude of thrust for said first marine propulsion unit as a function of said maneuver command; and second means for calculating a second magnitude of thrust for said second marine propulsion unit as a function of said maneuver command, said first and second magnitudes of thrust being calculated to create a resultant force vector imposed on said marine vessel and a resultant moment about an instantaneous center of turn of said marine vessel which will achieve said maneuver command, said first and second magnitudes of thrust being unequal to each other in order to create a magnitude of said resultant moment about said instantaneous center of turn which is unequal to zero.

19. The apparatus of claim 18, further comprising:

means for causing said first marine propulsion unit to provide said first magnitude of thrust; and means for causing said second marine propulsion unit to provide said second magnitude of thrust.

20. The apparatus of claim 19, further comprising:

means for changing the relative position of said first marine propulsion unit relative to said transom to change the direction of said first magnitude of thrust relative to said marine vessel; and means for changing the relative position of said second marine propulsion unit relative to said transom to change the direction of said second magnitude of thrust relative to said marine vessel.

* * * * *

US006234853C1

(12) INTER PARTES REEXAMINATION CERTIFICATE (0330th)

United States Patent
Lanyl et al.

(10) Number: US 6,234,853 C1
(45) Certificate Issued: Dec. 13, 2011

(54) SIMPLIFIED DOCKING METHOD AND APPARATUS FOR A MULTIPLE ENGINE MARINE VESSEL

(75) Inventors: William D. Lanyl, Malone, WI (US); Jeffery C. Ehlers, Neenah, WI (US); Blake R. Suhre, Neenah, WI (US)

(73) Assignee: Brunswick Corporation, Lake Forest, IL (US)

Reexamination Request:
No. 95/000,346, Feb. 13, 2008

Reexamination Certificate for:

| | |
|---|---|
| Patent No.: | **6,234,853** |
| Issued: | **May 22, 2001** |
| Appl. No.: | **09/502,816** |
| Filed: | **Feb. 11, 2000** |

(51) Int. Cl.
*B63H 20/08* (2006.01)

(52) U.S. Cl. ..... 440/53; 114/144 R
(58) Field of Classification Search ..... None
See application file for complete search history.

(56) References Cited

To view the complete listing of prior art documents cited during the proceeding for Reexamination Control Number 95/000,346, please refer to the USPTO's public Patent Application Information Retrieval (PAIR) system under the Display References tab.

*Primary Examiner*—Cary Wehner

(57) ABSTRACT

A docking system is provided which utilizes the marine propulsion unit of a marine vessel, under the control of an engine control unit that receives command signals from a joystick or push button device, to respond to a maneuver command from the marine operator. The docking system does not require additional propulsion devices other than those normally used to operate the marine vessel under normal conditions. The docking or maneuvering system of the present invention uses two marine propulsion units to respond to an operator's command signal and allows the operator to select forward or reverse commands in combination with clockwise or counterclockwise rotational commands either in combination with each other or alone.

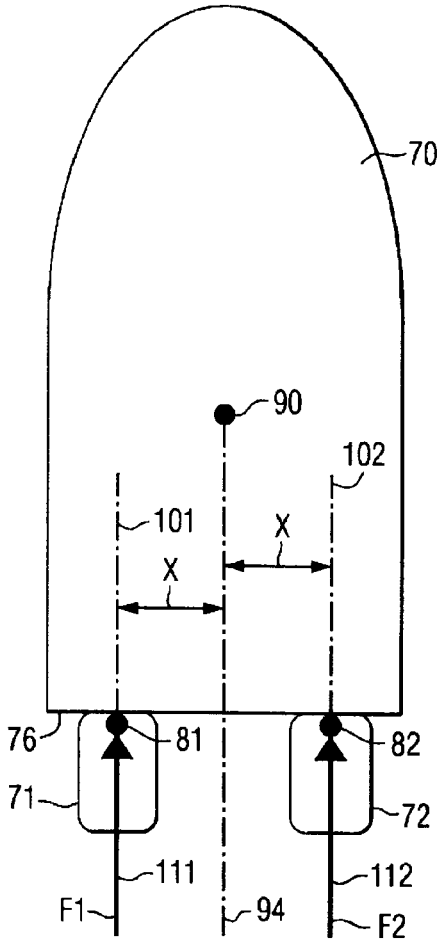

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-20 are cancelled.

* * * * *